US011043323B2

(12) United States Patent
Yamaguchi

(10) Patent No.: US 11,043,323 B2
(45) Date of Patent: Jun. 22, 2021

(54) VARIABLE INDUCTOR

(71) Applicant: MURATA MANUFACTURING CO., LTD., Kyoto-fu (JP)

(72) Inventor: Koichi Yamaguchi, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 397 days.

(21) Appl. No.: 15/202,767

(22) Filed: Jul. 6, 2016

(65) Prior Publication Data

US 2017/0040103 A1 Feb. 9, 2017

(30) Foreign Application Priority Data

Aug. 4, 2015 (JP) ..... JP2015-154009

(51) Int. Cl.
*H01F 21/02* (2006.01)
*H01F 27/255* (2006.01)
*H01F 21/06* (2006.01)

(52) U.S. Cl.
CPC ..... *H01F 27/255* (2013.01); *H01F 21/06* (2013.01)

(58) Field of Classification Search
CPC .... H01F 21/08; H01F 2027/348; H01F 21/06; H01F 29/10; H01F 27/34; H01F 27/255
USPC ..... 336/40, 130, 132; 324/200, 207.2
See application file for complete search history.

(56) References Cited

U.S. PATENT DOCUMENTS 2,826,748 A * 3/1958 Newton ..... H01F 21/08 336/155
3,513,408 A * 5/1970 McGee ..... G01D 5/2013 324/207.16
3,735,305 A * 5/1973 Sinnott ..... H01F 21/08 336/110
4,035,695 A * 7/1977 Knutson ..... H01F 17/0006 361/782
4,538,863 A * 9/1985 Allen ..... H01F 38/14 439/39
4,811,823 A * 3/1989 Raymond ..... F16D 37/02 188/267.2

(Continued)

FOREIGN PATENT DOCUMENTS

FR 2709861 A1 * 3/1995 ..... H01F 29/10
JP S35-029749 U 11/1960

(Continued)

OTHER PUBLICATIONS

An Office Action; "Notification of Reasons for Rejection," issued by the Japanese Patent Office dated Mar. 20, 2018, which corresponds to Japanese Patent Application No. 2015-154009 and is related to U.S. Appl. No. 15/202,767.

*Primary Examiner* — Alexander Talpalatski
*Assistant Examiner* — Joselito S. Baisa
(74) *Attorney, Agent, or Firm* — Studebaker & Brackett PC

(57) ABSTRACT

First and second coils are disposed coaxially with a gap provided therebetween and are configured to mutually cancel out magnetic fields provided thereby. A receptacle portion that defines a space traversing at least a portion of a magnetic flux produced by the coils is provided, and a magnetic powder is contained in the receptacle portion so as to occupy a portion of the space. The magnetic powder moves within the space, and this movement produces a change in the magnetic flux. This change in the magnetic flux appears in the form of a change in the inductance value.

20 Claims, 6 Drawing Sheets

(56) References Cited

U.S. PATENT DOCUMENTS 6,100,477 A * 8/2000 Randall ..... H01P 1/12 200/181
6,184,755 B1 * 2/2001 Barber ..... H01F 17/0006 331/181
6,369,684 B1 * 4/2002 Iida ..... H01F 17/0006 29/602.1
6,375,884 B1 * 4/2002 Shikama ..... H01F 41/127 264/254
7,071,806 B2 * 7/2006 Masu ..... H01F 17/0006 29/602.1
7,102,480 B2 * 9/2006 Bergstedt ..... H01H 50/005 336/200
7,138,898 B2 * 11/2006 Ishikawa ..... H01F 17/0006 336/200
7,403,090 B2 * 7/2008 Kita ..... H01F 5/003 336/200
7,477,442 B2 * 1/2009 Iwamatsu ..... G02F 1/167 345/107
7,738,850 B2 * 6/2010 Byun ..... H04B 1/18 333/129
7,889,026 B2 * 2/2011 Parsche ..... H01F 21/08 333/174
7,990,625 B2 * 8/2011 Ke ..... G02B 7/08 359/696
8,319,592 B2 * 11/2012 Kawarai ..... H01F 27/365 336/134
8,410,883 B2 * 4/2013 Asplund ..... H01F 37/005 336/84 C
8,830,016 B2 * 9/2014 Rofougaran ..... H01F 21/06 200/181
2005/0088267 A1 * 4/2005 Watts ..... H01F 17/08 336/178
2006/0029959 A1 * 2/2006 Okamoto ..... C12Q 1/6816 435/6.12
2009/0174501 A1 * 7/2009 Parsche ..... H03H 5/12 333/174
2009/0226834 A1 * 9/2009 Matsumura ..... G03G 9/0804 430/105
2010/0117776 A1 * 5/2010 Israelsson Tampe ..... H01F 27/085 336/59
2011/0025447 A1 * 2/2011 Jacobson ..... H01F 27/362 336/84 C
2011/0234354 A1 * 9/2011 Kawarai ..... H01F 21/06 336/136
2012/0169134 A1 * 7/2012 Choudhary ..... H04B 5/0081 307/104
2014/0286054 A1 * 9/2014 Krause ..... H01F 3/12 363/16
2014/0327508 A1 11/2014 Kim et al.

FOREIGN PATENT DOCUMENTS

JP 63205544 A * 8/1988
JP 2009-152254 A 7/2009
JP 2010-135699 A 6/2010

* cited by examiner

VARIABLE INDUCTOR

CROSS REFERENCE TO RELATED APPLICATIONS

This application claims benefit of priority to Japanese Patent Application 2015-154009 filed Aug. 4, 2015, the entire content of which is incorporated herein by reference.

TECHNICAL FIELD

The present disclosure relates to variable inductors and, in particular, relates to a variable inductor that can vary an inductance value by varying the magnetic permeability in a portion through which a magnetic flux passes.

BACKGROUND

Variable inductors of interest to the present disclosure include, for example, a variable inductor described in Japanese Unexamined Patent Application Publication No. 2010-135699 or a variable inductor described in Japanese Unexamined Patent Application Publication No. 2009-152254.

Japanese Unexamined Patent Application Publication No. 2010-135699 describes a variable inductor that includes a first coil, a second coil that produces a magnetic flux in a direction that cancels out a magnetic flux produced by the first coil, a movable core that moves between the first coil and the second coil so as to block the magnetic fluxes produced by the first coil and the second coil, and a magnetic core of a closed magnetic circuit structure that encloses the first coil, the second coil, and the movable core.

Japanese Unexamined Patent Application Publication No. 2009-152254 describes an on-chip variable inductor provided as a wafer level package that is constituted by a semiconductor substrate, an integrated circuit layer on the semiconductor substrate, an insulation layer on the integrated circuit layer, and a redistribution layer on the insulation layer. In this variable inductor, a first inductor is formed in the integrated circuit layer, a second inductor is formed in the redistribution layer, and a current control circuit is connected to the first inductor. As the amplitude and/or the phase of a current input to the first inductor are/is controlled, a magnetic flux that passes through the second inductor is varied.

SUMMARY

However, the variable inductor described in Japanese Unexamined Patent Application Publication No. 2010-135699 needs to be configured such that the movable core is mechanically moved while being held stably and the magnetic fluxes produced by the first coil and the second coil are selectively blocked. Thus, the operation stability of the movable unit is likely to become a problem. In addition, the movable core has a relatively large mass, and thus a problem arises in that moving the movable core requires a relatively large amount of electric power and the reaction speed of an operation is low.

In the meantime, in the variable inductor described in Japanese Unexamined Patent Application Publication No. 2009-152254, since the amplitude and/or the phase of the current input to the first inductor are/is controlled, the current has to be passed continuously, but a DC current component ceases to contribute to the control after the inductance value is varied and thus can be considered to be a wasted current. Accordingly, there is a problem in that the power efficiency of the current control circuit deteriorates and the energy efficiency of the variable inductor deteriorates in turn.

Accordingly, it is an object of one embodiment of the present disclosure to provide a variable inductor that enables the above-described problems to be reduced, or in other words, a variable inductor that can vary an inductance value stably and quickly and that does not require much energy for achieving a desired operation.

According to one embodiment of the present disclosure, a variable inductor includes at least one coil that produces a magnetic flux. Then, the variable inductor further includes a receptacle portion that defines a space traversing at least a portion of the magnetic flux produced by the at least one coil, and a magnetic powder contained in the receptacle portion so as to occupy a portion of the space. The magnetic powder can move within the space, and this movement produces a change in the magnetic flux. Herein, a change in the magnetic flux corresponds to a change in how easily the magnetic flux passes, a change in the path of the magnetic flux, or the like. Such a change in the magnetic flux appears in the form of a change in an inductance value.

According to another embodiment of the present disclosure, it is preferable that the space defined by the receptacle portion include a first region in which a magnetic field provided by the at least one coil is relatively strong and a second region in which the magnetic field is relatively weak and that the magnetic powder can move between the first region and the second region. According to this configuration, a change in the inductance value can be obtained more efficiently.

According to another embodiment of the present disclosure, it is preferable that the at least one coil include first and second coils that are disposed coaxially with a gap provided therebetween. In this case, the first coil and the second coil are configured to mutually cancel out the magnetic fields produced thereby, and at least a portion of the space is located between the first coil and the second coil. In this manner, when the variable inductor includes two coils, the amount of change in the inductance value can be increased as compared to a case in which the variable inductor includes only one coil.

According to another embodiment of the present disclosure, preferably, the magnetic powder is coated with a resin having an electrostatic property, the variable inductor further includes an electric field generating electrode for applying a voltage so as to generate an electric field within the space, and the magnetic powder is moved within the space by applying a voltage to the electric field generating electrode.

According to this configuration, the magnetic powder can be moved only by applying a voltage to the electric field generating electrode from the outside, and the inductance value can be varied accordingly. At this point, electric power necessary for moving the magnetic powder is comparatively smaller than the electric power necessary for moving the movable core described in Japanese Unexamined Patent Application Publication No. 2010-135699. In addition, since the magnetic powder has an electrostatic property, the magnetic powder does not easily move even when the voltage ceases to be applied to the electric field generating electrode. Thus, no electric power is required to keep the position of the magnetic powder. Accordingly, the power consumption can be reduced.

In the embodiments described above, it is preferable that the electric field generating electrode include a substantially comb-shaped portion spreading along a wall surface of the receptacle portion that defines the space. With this, an occurrence of an eddy current that reduces a Q value of the inductor can be suppressed.

The variable inductor according to another embodiment of the present disclosure may include a configuration that allows the magnetic powder to move within the space by its own weight, aside from the configuration for moving the magnetic powder by an electric field, as described above.

According to one embodiment of the present disclosure, as the magnetic powder moves through the space within the receptacle portion, the magnetic flux produced by the coil varies, and the inductance value provided by the coil can be varied. In this manner, movement of the relatively light-weight magnetic powder is used to vary the inductance value, and merely the receptacle portion for housing the magnetic powder needs to be prepared in order to movably hold the magnetic powder. Thus, a problem that could be faced when operating a movable unit such as the movable core having a relatively large mass can be avoided advantageously. In other words, a mechanism for operably holding a movable unit such as the movable core is not necessary. In addition, since the magnetic powder is relatively light-weight, advantageously, the variable inductor can be expected to excel in the operation stability, to have a high operation reaction speed, and not to require much energy for achieving a desired operation.

Other features, elements, characteristics and advantages of some embodiments of the present disclosure will become more apparent from the following detailed description of some embodiments of the present disclosure with reference to the attached drawings.

BRIEF DESCRIPTION OF THE DRAWINGS

FIGS. 6A through 6F are sectional views of the variable inductor illustrated in FIG. 3, in which FIG. 6A is a sectional view taken along the 6-6 line indicated in FIG. 5, FIG. 6B is a sectional view taken along the 7-7 line indicated in FIG. 5, FIG. 6C is a sectional view taken along the 8-8 line indicated in FIG. 5, FIG. 6D is a sectional view taken along the 9-9 line indicated in FIG. 5, FIG. 6E is a sectional view taken along the 10-10 line indicated in FIG. 5, and FIG. 6F is a sectional view taken along the 11-11 line indicated in FIG. 5.

DETAILED DESCRIPTION

Figure 1:
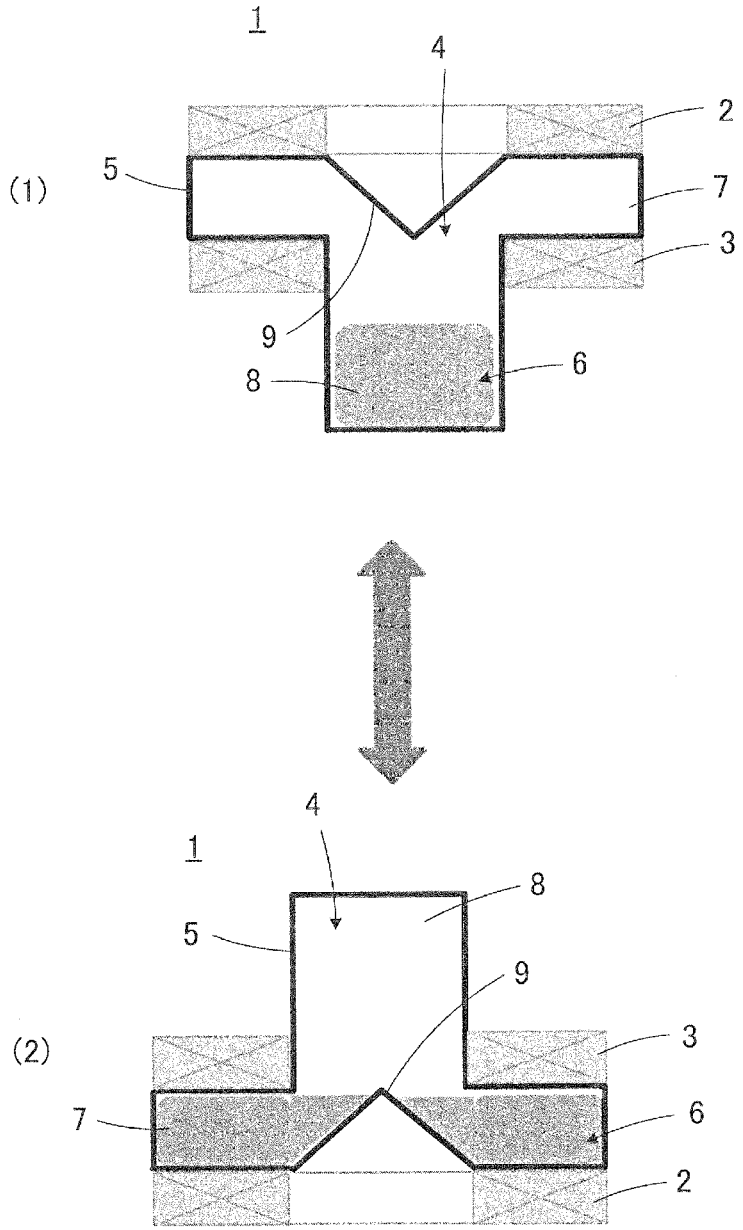
FIG. 1 is a sectional view illustrating a variable inductor according to a first embodiment of the present disclosure, and illustrates the variable inductor in two typical states in which an inductance value is varied in accordance with a first operation principle.

FIG. 1 illustrates a variable inductor 1 according to a first embodiment of the present disclosure. The variable inductor 1 can take two typical states illustrated in sections (1) and (2) of FIG. 1 and thus varies the inductance value.

The variable inductor 1 includes a first coil 2 and a second coil 3. The first coil 2 and the second coil 3 are disposed coaxially with a gap provided therebetween. The first coil 2 and the second coil 3 are configured to mutually cancel out magnetic fields provided thereby.

The variable inductor 1 further includes a receptacle portion 5 that defines a space 4 traversing at least a portion of magnetic fluxes produced by the first and second coils 2 and 3, and a magnetic powder 6 contained in the receptacle portion 5 so as to occupy a portion of the space 4. For example, a ferrite powder or a metal powder in general, such as a carbonyl iron powder or a nickel powder, that is used in a magnetic fluid can be used as the magnetic powder 6.

The space 4 defined by the receptacle portion 5 includes a first region 7 in which the magnetic field provided by the first and second coils 2 and 3 is relatively strong and a second region 8 in which the magnetic field is relatively weak. To be more specific, the space 4 has a substantially T-shaped section, the first region 7 is located at a position between the first coil 2 and the second coil 3, and the second region 8 is located at a position that is on a side of the second coil 3 opposite to the position where the first coil 2 is located and that is spaced apart from the second coil 3.

In the present embodiment, the posture of the variable inductor 1 is changed in order to vary the inductance value. As the posture of the variable inductor 1 is changed, the magnetic powder 6 can move reversibly by its own weight between the first region 7 and the second region 8 within the space 4.

To be more specific, in the section (1) of FIG. 1, the variable inductor 1 assumes a posture in which the second region 8 of the receptacle portion 5 is located downward, and the magnetic powder 6 is settled in the second region 8 by its own weight. In the meantime, in the section (2) of FIG. 1, the variable inductor 1 assumes a posture in which the first region 7 of the receptacle portion 5 is located downward, and the magnetic powder 6 is settled in the first region 7 by its own weight. The receptacle portion 5 may be provided with a substantially conical guide surface 9 so that the magnetic powder 6 can move to the first region 7 smoothly.

As the magnetic powder 6 is displaced as described above, a change in the magnetic fluxes produced by the first and second coils 2 and 3 is produced. To be more specific, the movement of the magnetic powder 6 changes how easily the magnetic flux passes, in a similar manner to when the distance between the first coil 2 and the second coil 3 is changed. The change in the magnetic flux appears in the form of a change in the inductance value in the variable inductor 1. In other words, the inductance value of the variable inductor 1 in a state in which the magnetic powder 6 is in the second region 8 in which the magnetic field provided by the first and second coils 2 and 3 is relatively weak as illustrated in the section (1) of FIG. 1 is smaller than the inductance value of the variable inductor 1 in a state in which the magnetic powder 6 is in the first region 7 in which the magnetic field provided by the first and second coils 2 and 3 is relatively strong as illustrated in the section (2) of FIG. 1.

Such a change in the inductance value can be achieved repeatedly with reproducibility. Here, when focusing on the strength of the magnetic field provided by the first and second coils 2 and 3, as the difference between the strength of the magnetic field in the first region 7 and the strength of the magnetic field in the second region 8 is greater, the amount of change in the inductance value can be made greater.

Now, with reference to FIG. 2, a variable inductor 11 according to a second embodiment of the present disclosure will be described. The variable inductor 11 illustrated in FIG. 2 includes many elements that are common to those in the variable inductor 1 illustrated in FIG. 1. Therefore, in FIG. 2, the elements that are common to those illustrated in FIG. 1 are given identical reference numerals, and duplicate descriptions thereof will be omitted.

The variable inductor 11 includes, in addition to the elements provided in the variable inductor 1 described above, electric field generating electrodes 12 through 14 for applying a voltage so as to generate an electric field within the space 4 defined by the receptacle portion 5. The electric field generating electrode 12 is provided along an end wall of the receptacle portion 5 that defines a terminal of the second region 8 of the space 4. The electric field generating electrodes 13 and 14 are provided along a side wall of the receptacle portion 5 that defines the periphery of the first region 7 of the space 4. The electric field generating electrode 13 and the electric field generating electrode 14 are electrically connected in parallel and located so as to face each other.

A direct current power supply 15 is prepared separately from a signal system power supply (not illustrated) for the first and second coils 2 and 3. The voltage supplied from the direct current power supply 15 and the polarity of the voltage can be varied. The direct current power supply 15 applies a voltage across the electric field generating electrode 12 and the electric field generating electrodes 13 and 14, and thus an electric field is generated within the space 4.

In the meantime, in the variable inductor 11, a powder coated with a resin having an electrostatic property is used as the magnetic powder 6. To be more specific, a core material, such as magnetite, Mn-based soft ferrite, Mn—Mg-based soft ferrite, or Cu—Zn-based soft ferrite used as an electrophotographic carrier, coated with a resin is advantageously used as the magnetic powder 6. Thus, as a voltage of, for example, about several ten volts is applied across the electric field generating electrode 12 and the electric field generating electrodes 13 and 14 by the direct current power supply 15, the magnetic powder 6 moves within the space 4. By changing the polarity of the voltage supplied from the direct current power supply 15, the magnetic powder 6 can be moved toward the first region 7 or can be moved toward the second region 8 as indicated by double-headed arrows 16.

Figure 2:
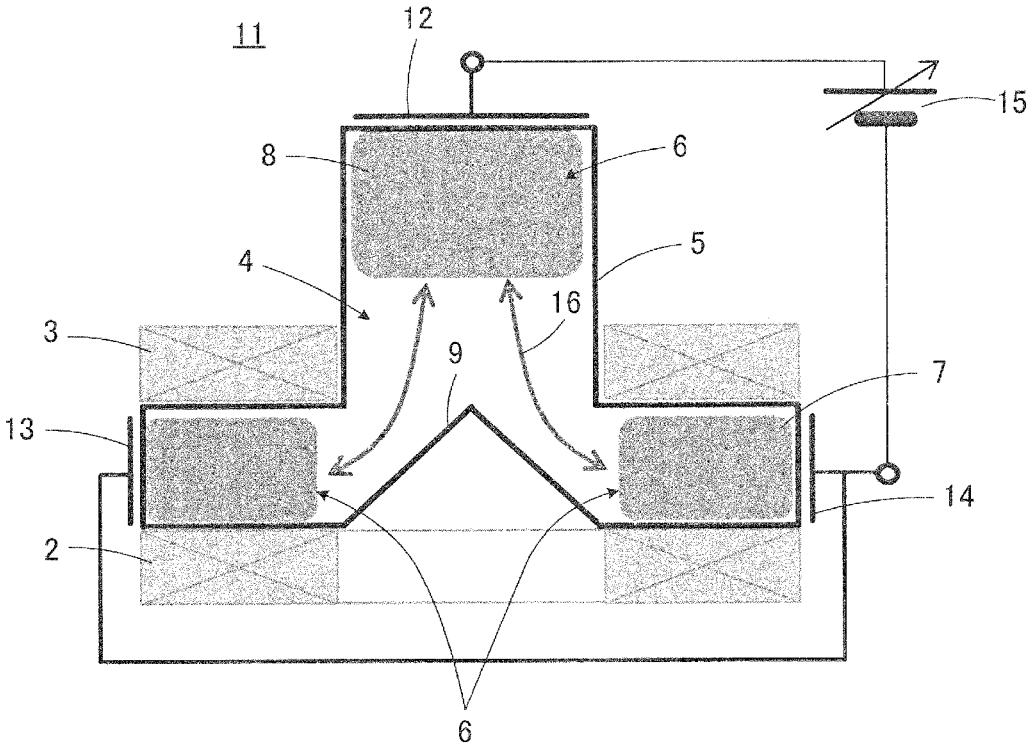
FIG. 2 is a sectional view illustrating a variable inductor according to a second embodiment of the present disclosure, and illustrates a configuration in which an inductance value can be varied in accordance with a second operation principle.

To be more specific, when the direct current power supply 15 has a polarity as illustrated in FIG. 2, a positive potential is given to the electric field generating electrode 12, and negative potentials are given to the electric field generating electrodes 13 and 14. At this point, if the magnetic powder 6 is positively charged, the magnetic powder 6 is attracted toward the electric field generating electrodes 13 and 14 having negative potentials and moves to the first region 7. As a result, the variable inductor 11 provides a relatively high inductance value. Thereafter, even if the direct current power supply 15 is turned off, a state in which the magnetic powder 6 remains in the first region 7 is retained.

In the meantime, when the inductance value of the variable inductor 11 is to be made relatively small, the polarity of the direct current power supply 15 is switched. In other words, a negative potential is given to the electric field generating electrode 12, and positive potentials are given to the electric field generating electrodes 13 and 14. As described above, if the magnetic powder 6 is positively charged, the magnetic powder 6 is attracted toward the electric field generating electrode 12 having a negative potential and moves to the second region 8. As a result, the variable inductor 11 provides a relatively low inductance value. Thereafter, even if the direct current power supply 15 is turned off, a state in which the magnetic powder 6 remains in the second region 8 is retained.

Although the magnetic powder 6 is depicted as being present in both the first region 7 and the second region 8 in FIG. 2, in reality, the magnetic powder 6 is typically present in either one of the first region 7 and the second region 8.

However, when a driving system of electronic paper, which is attracting attention as a display medium on which the display content can be electrically overwritten, is applied, only a specific portion of the magnetic powder 6 can be moved, and thus the magnetic powder 6 can be distributed in both the first region 7 and the second region 8 at a specific rate. In that case, an intermediate inductance value can also be achieved. This modification can also be applied to other embodiments described later.

The space 4 may be filled not only with a gas but also with a liquid. For example, when the space 4 is filled with a liquid such as a silicone oil, the speed at which the magnetic powder 6 moves is lower than the speed at which the magnetic powder 6 moves when the space 4 is filled with a gas. However, an electric field is more easily applied, and thus the voltage to be applied across the electric field generating electrode 12 and the electric field generating electrodes 13 and 14 can be reduced. This modification can also be applied to other embodiments described later.

With reference to FIGS. 3 through 6F, a variable inductor 21 according to a third embodiment of the present disclosure will now be described.

In the variable inductors 1 and 11 described above, it is intended that the first and second coils 2 and 3 are constituted by windings, although not particularly limited thereto. In contrast, the variable inductor 21 is a chip type inductor that includes a coil of a laminate structure and is fabricated by applying a lamination technique.

Figure 3:
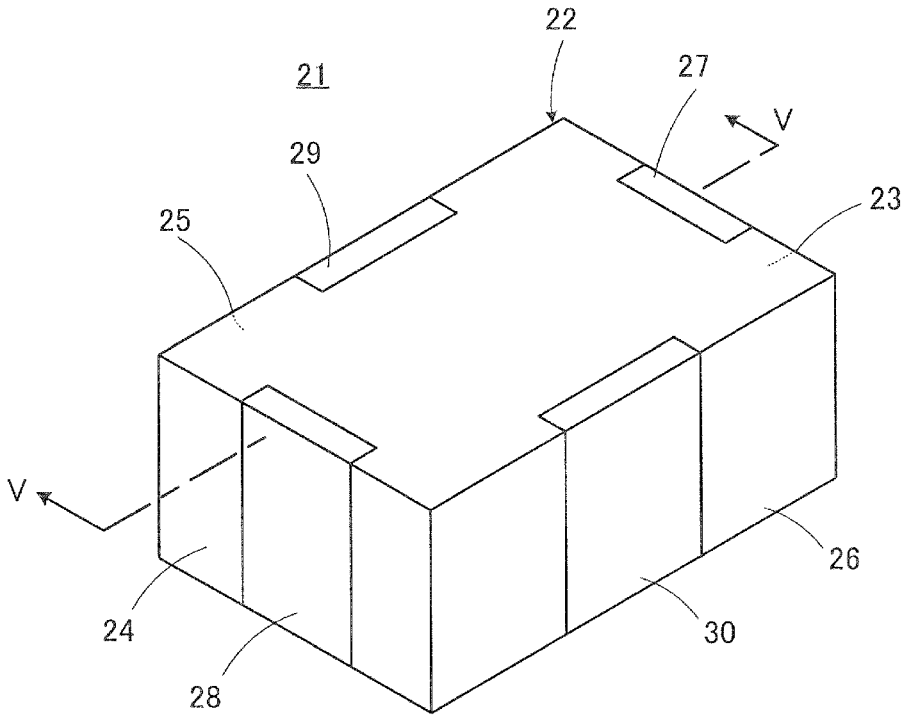
FIG. 3 is a perspective view illustrating an appearance of a variable inductor according to a third embodiment of the present disclosure.

The variable inductor 21 includes a rectangular parallelepiped component body 22 having a laminate structure. As illustrated in FIG. 3, opposing end surfaces 23 and 24 of the component body 22 are provided with first and second external terminal electrodes 27 and 28, respectively, and opposing side surfaces 25 and 26, which are each adjacent to the end surfaces 23 and 24, are provided with third and fourth external terminal electrodes 29 and 30, respectively. These external terminal electrodes 27 through 30 are provided so as to fill the cutouts that are formed in the end surfaces 23 and 24 and the side surfaces 25 and 26, respectively, of the component body 22 so as to penetrate the component body 22 in the thickness direction thereof.

The above-described mode of the external terminal electrodes 27 through 30 results from the method of fabricating the variable inductor 21. When the component body 22 is fabricated, a component body in the mother state that, when cut along cut lines in the X direction and the Y direction, can yield a plurality of component bodies 22 is fabricated. This component body in the mother state has through-holes having a rectangular planar shape for locating the cut lines formed therein on the center line, and the through-holes are filled with a conductor. Then, the component body in the mother state is cut along the cut lines, and thus a plurality of component bodies 22 are produced. At this point, since the cut lines pass through the center lines of the above-described through-holes, and thus the conductor filling the through-holes is divided as being cut, which results in the external terminal electrodes 27 through 30 described above.

Figure 4:
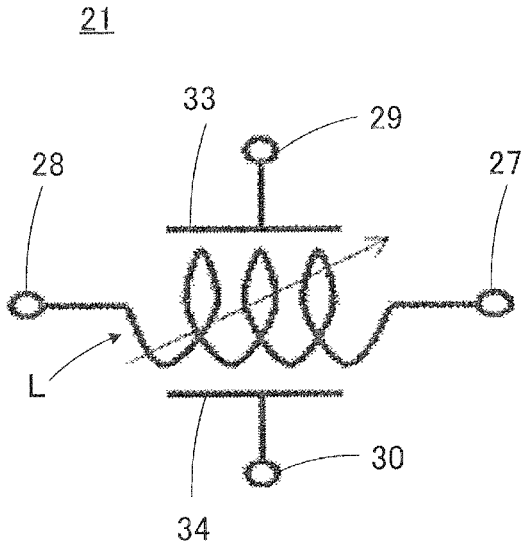
FIG. 4 is an equivalent circuit diagram of the variable inductor illustrated in FIG. 3.

As illustrated in FIG. 4, an inductance L is formed between the first and second external terminal electrodes 27 and 28, and the inductance L can be varied in accordance with a voltage applied across the third and fourth external terminal electrodes 29 and 30.

The variable inductor 21 includes elements corresponding to the elements provided in the variable inductor 11 illustrated in FIG. 2. In other words, the variable inductor 21 forms first and second coils 31 and 32 and electric field generating electrodes 33 and 34 inside the component body 22 and constitutes a receptacle portion 36 that defines a space 35 by a portion of the component body 22.

Figure 5:
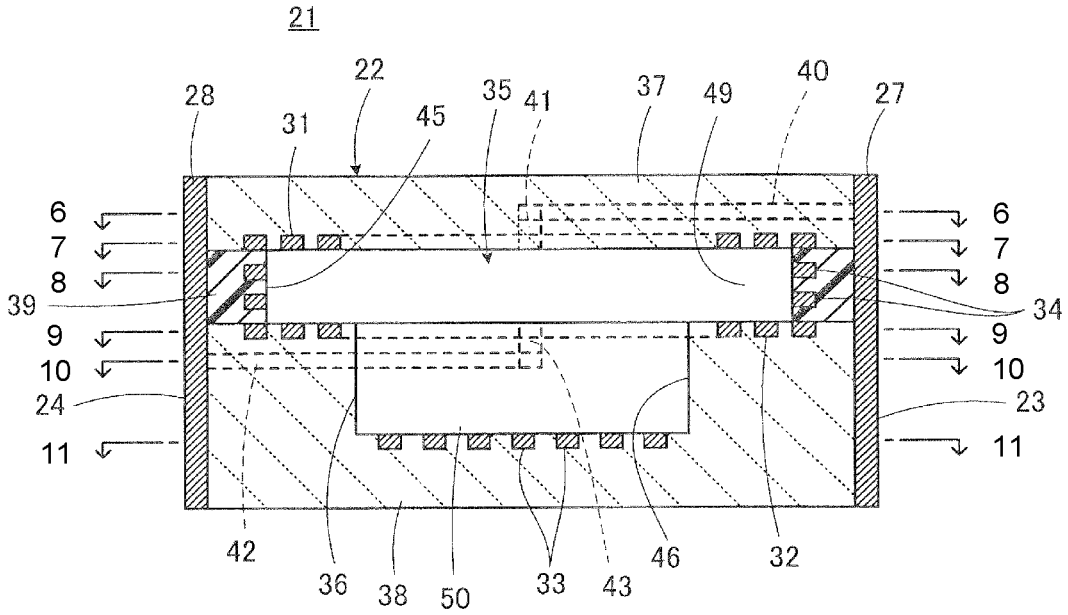
FIG. 5 is a sectional view of the variable inductor illustrated in FIG. 3 taken along the V-V line.
Figure 6A:
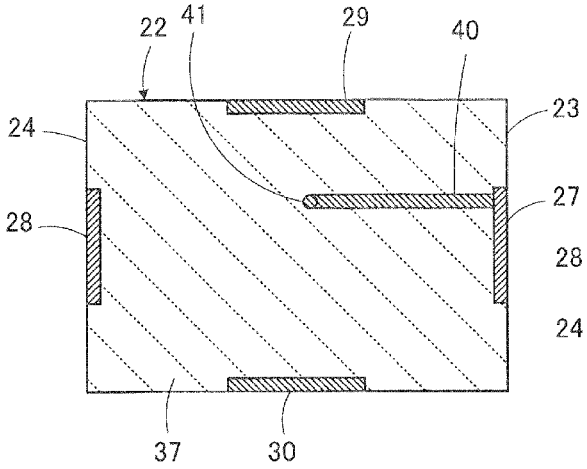
Figure 6D:
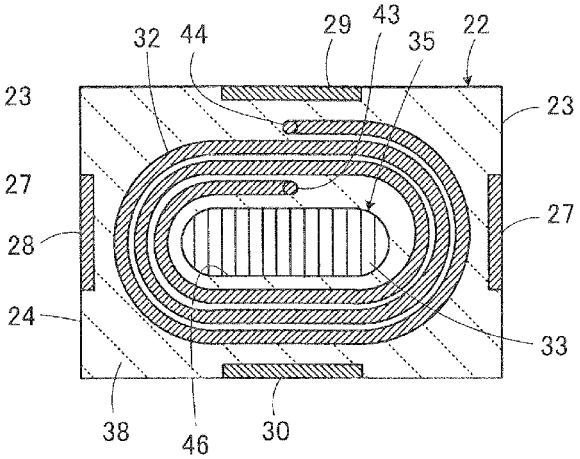

As illustrated in FIG. 5, the component body 22 has a laminate structure in which a resin layer 39 made of polyimide or the like is sandwiched between first and second insulating substrates 37 and 38 made of alumina or the like. The first insulating substrate 37 is also depicted in FIGS. 6A and 6B, the resin layer 39 is also depicted in FIG. 6C, and the second insulating substrate 38 is also depicted in FIGS. 6D through 6F.

Figure 6B:
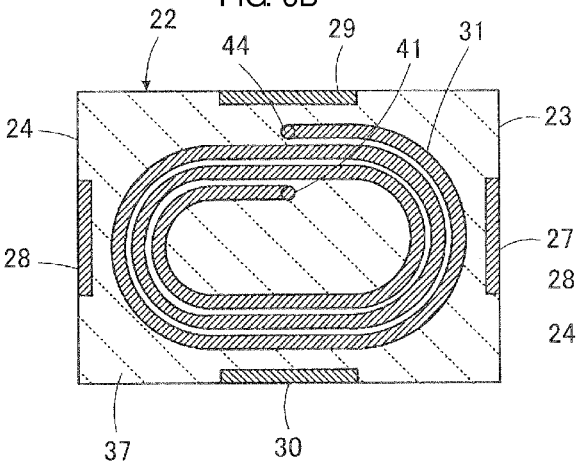
Figure 6E:
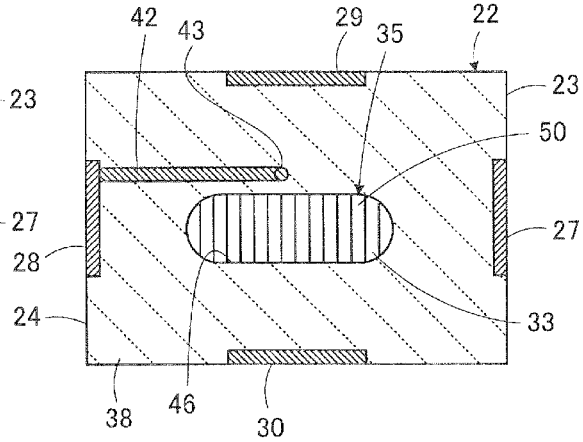
Figure 6C:
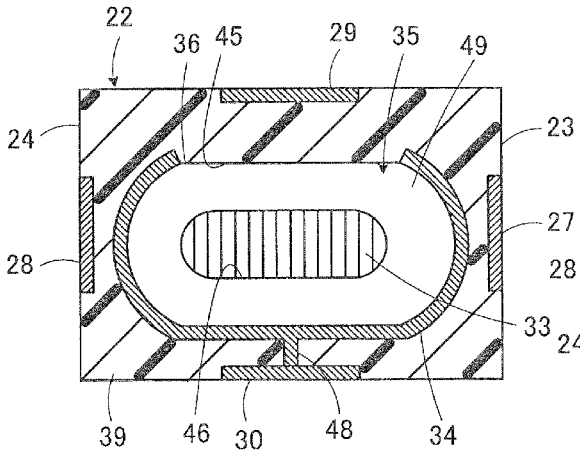
Figure 6F:
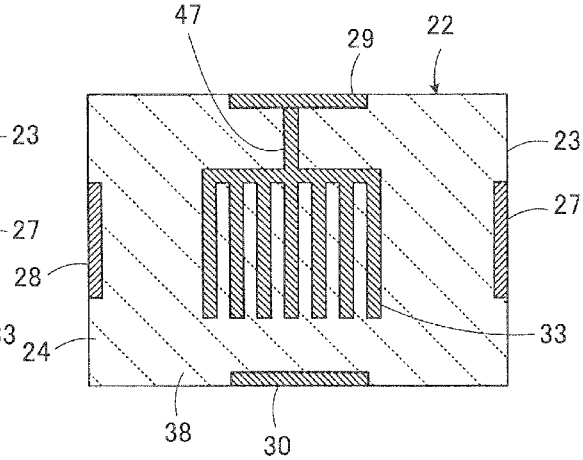

As illustrated in FIG. 6B as well, the first coil 31 is constituted, for example, by a spiral pattern conductor made of copper and is provided in the first insulating substrate 37. Here, the first coil 31 is located in the first insulating substrate 37 on a side that makes contact with the resin layer 39. The first coil 31 is coated for insulation as necessary. The first insulating substrate 37 has a laminate structure composed of a plurality of insulator layers, and an extended conductor 40 is provided in an insulator layer different from the insulator layer in which the first coil 31 is located, as illustrated in FIG. 6A. One end of the extended conductor 40 is electrically connected to an inner peripheral end of the first coil 31 with a via conductor 41 that penetrates a specific insulator layer interposed therebetween, and the other end of the extended conductor 40 is electrically connected to the first external terminal electrode 27.

As illustrated in FIG. 6D as well, the second coil 32 is provided in the second insulating substrate 38. Similarly to the first coil 31, the second coil 32 is constituted, for example, by a spiral pattern conductor made of copper. In addition, the second coil 32 is located in the second insulating substrate 38 on a side that makes contact with the resin layer 39. The second coil 32 is coated for insulation as necessary. The second insulating substrate 38 also has a laminate structure composed of a plurality of insulator layers, and an extended conductor 42 is provided in an insulator layer different from the insulator layer in which the second coil 32 is located, as illustrated in FIG. 6E. One end of the extended conductor 42 is electrically connected to an inner peripheral end of the second coil 32 with a via conductor 43 that penetrates a specific insulator layer interposed therebetween, and the other end of the extended conductor 42 is electrically connected to the second external terminal electrode 28.

As described above, an outer peripheral end of the first coil 31 located in the first insulating substrate 37 on the side that makes contact with the resin layer 39 and an outer peripheral end of the second coil 32 located in the second insulating substrate 38 on the side that makes contact with the resin layer 39 are electrically connected to each other by a via conductor 44 illustrated in FIGS. 6B and 6D. The via conductor 44 is provided so as to penetrate the resin layer 39.

As described thus far, the first coil 31 and the second coil 32 are disposed coaxially with a gap provided therebetween, and the first coil 31 and the second coil 32 are configured to mutually cancel out the magnetic fields provided thereby.

A through-hole 45 is provided in the resin layer 39 so as to penetrate the resin layer 39 in the thickness direction thereof. As illustrated in FIG. 6C, the through-hole 45 has a substantially elliptic planar shape. In addition, a concave portion 46 is provided in the second insulating substrate 38 such that the concave portion 46 opens on a side that makes contact with the resin layer 39 and communicates with the through-hole 45. As illustrated in FIGS. 6C through 6E, the concave portion 46 is smaller than the through-hole 45 and has a substantially elliptic planar shape. The base of the concave portion 46 is located at a position sufficiently spaced apart from the second coil 32.

The above-described space 35 is provided by the through-hole 45 and the concave portion 46. Accordingly, the receptacle portion 36 that defines the space 35 is provided by a portion of the component body 22. The space 35 is located so as to traverse at least a portion of magnetic fluxes produced by the first and second coils 31 and 32. The magnetic powder is contained in the receptacle portion 36 so as to occupy a portion of the space 35, but the magnetic powder is omitted from the drawings in FIGS. 5 through 6F. In addition, in the variable inductor 21 as well, a powder coated with a resin having an electrostatic property is used as the magnetic powder, as in the case of the variable inductor 11 illustrated in FIG. 2.

The above-described electric field generating electrode 33 is provided in the second insulating substrate 38, as clearly illustrated in FIG. 6F. The electric field generating electrode 33 is provided in, among a plurality of insulator layers constituting the second insulating substrate 38, an insulator layer that provides the base of the concave portion 46 and is partially exposed through the base of the concave portion 46. The electric field generating electrode 33 includes a substantially comb-shaped portion spreading along the bottom wall of the receptacle portion 36 that defines the space 35. Accordingly, an occurrence of an eddy current that reduces the Q value of the inductor can be suppressed. As illustrated in FIG. 6F, the electric field generating electrode 33 is electrically connected to the third external terminal electrode 29 with an extended conductor 47 interposed therebetween.

The electric field generating electrode 34, which is paired with the electric field generating electrode 33, is located in the resin layer 39 and is provided so as to be exposed through the peripheral surface of the through-hole 45. As can be seen from FIG. 5, the electric field generating electrode 34 includes a substantially comb-shaped portion spreading along the side wall of the receptacle portion 36 that defines the space 35. Although a detailed illustration is omitted, the comb teeth of the substantially comb-shaped portion of the electric field generating electrode 34 are electrically connected to one another by a conductor that extends in the thickness direction of the resin layer 39. In addition, as illustrated in FIG. 6C, the electric field generating electrode 34 is electrically connected to the fourth external terminal electrode 30 with an extended conductor 48 interposed therebetween.

As described above, as the electric field generating electrodes 33 and 34 each include a substantially comb-shaped portion, an occurrence of an eddy current that reduces the Q value of the inductor can be suppressed.

With reference to FIG. 5, the above-described space 35 includes a first region 49 in which a magnetic field provided by the first and second coils 31 and 32 is relatively strong and a second region 50 in which the magnetic field is relatively weak. In the present embodiment, the first region 49 is located at a position between the first coil 31 and the second coil 32, or in other words, at a position defined by the through-hole 45; and the second region 50 is located at a position that is on a side of the second coil 32 opposite to the side where the first coil is located and that is sufficiently spaced apart from the second coil 32, or in other words, at a position in the vicinity of the base of the concave portion 46.

When the variable inductor 21 is fabricated, the second insulating substrate 38 is obtained through the following processes. Specifically, the electric field generating electrode 33 and the extended conductor 47 are formed in a specific insulator layer that is to partially constitute the second insulating substrate 38. Another insulator layer having a through-hole that is to partially constitute the concave portion 46 is laminated on the aforementioned specific insulator layer, and the extended conductor 42 is formed in the other insulator layer. Then, yet another insulator layer having a through-hole that is to constitute the remaining portion of the concave portion 46 and provided with the via conductor 43 is laminated on the aforementioned insulator layer, and the second coil 32 is formed in the yet another insulator layer.

In addition, when the variable inductor 21 is fabricated, the resin layer 39 performs a function of bonding the first and second insulating substrates 37 and 38 to each other, and before the first and second insulating substrates 37 and 38 are bonded, the resin layer 39 includes the through-hole 45 and has the electric field generating electrode 34, the extended conductor 48, and the via conductor 44 provided therein. The resin layer 39 has a laminate structure. When the electric field generating electrode 34 having a substantially comb-shaped portion is to be formed, the comb teeth are provided in different layers of the resin layer 39 and are connected to one another by a conductor that extends in the thickness direction of the resin layer 39. In addition, preferably, the resin layer 39 is disposed between the first and second insulating substrates 37 and 38 in a semi-solidified state, and as this resin layer 39 is solidified, the first and second insulating substrates 37 and 38 become bonded to each other.

The variable inductor 21 is made to function as an inductor by connecting the first and second external terminal electrodes 27 and 28 to a signal path and has its inductance value varied by applying a voltage having predetermined voltage value and polarity across the third and fourth external terminal electrodes 29 and 30.

The mechanism for varying the inductance value is substantially the same as that of the case of the variable inductor 11 illustrated in FIG. 2. In simple terms, when a voltage having a specific polarity is applied across the electric field generating electrodes 33 and 34 with the third and fourth external terminal electrodes 29 and 30 interposed therebetween, the magnetic powder is attracted toward either one of the electric field generating electrodes 33 and 34 and moves toward either one of the first region 49 and the second region 50. This state is retained even after the voltage ceases to be applied across the electric field generating electrodes 33 and 34.

In the meantime, when the polarity of the voltage applied across the electric field generating electrodes 33 and 34 is switched, the magnetic powder is attracted toward the other one of the electric field generating electrodes 33 and 34 and moves toward the other one of the first region 49 and the second region 50. This state is retained even after the voltage ceases to be applied across the electric field generating electrodes 33 and 34.

Now, with reference to FIG. 7, a variable inductor 51 according to a fourth embodiment of the present disclosure will be described. As can be seen by comparing FIG. 7 with FIG. 5, the variable inductor 51 illustrated in FIG. 7 includes many elements that are common to those in the variable inductor 21 illustrated in FIG. 5. Therefore, in FIG. 7, the elements that correspond to those illustrated in FIG. 5 are given identical reference numerals, and duplicate descriptions thereof will be omitted.

The above-described variable inductor 1, 11, and 21 include two coils 2 and 3 (or 31 and 32) that are disposed coaxially with a gap provided therebetween and that are configured to mutually cancel out the magnetic fields provided thereby. Meanwhile, the variable inductor 51 illustrated in FIG. 7 includes only a single coil 52.

An outer peripheral end of the coil 52 is electrically connected to the first external terminal electrode 27 with an extended conductor 53 interposed therebetween, and an inner peripheral end of the coil 52 is electrically connected to the second external terminal electrode 28 with a via conductor 54 and an extended conductor 55 interposed therebetween.

In a space 56 that traverses at least a portion of a magnetic flux produced by the coil 52, a first region 57 in which a magnetic field provided by the coil 52 is relatively strong is a portion enclosed by the coil 52, or in other words, a portion corresponding to the inside of the concave portion 46, and a second region 58 in which the magnetic field provided by the coil 52 is relatively weak is located at a position sufficiently spaced apart from the coil 52, or in other words, a portion corresponding to a relatively upper portion inside the through-hole 45. In the present embodiment, the positional relation between the first region 57 and the second region 58 in the space 56 is reversed from the positional relation between the first region 49 and the second region 50 in the space 35 of the variable inductor 21 described above. In addition, the concave portion 46 that serves as the first region 57 is shallower than the concave portion 46 that serves as the second region 50 in the variable inductor 21 described above.

When a voltage having a specific polarity is applied across the electric field generating electrodes 33 and 34, the magnetic powder (not illustrated) is attracted toward either one of the electric field generating electrodes 33 and 34 and moves toward either one of the first region 57 and the second region 58. In the meantime, when the polarity of the voltage applied across the electric field generating electrodes 33 and 34 is switched, the magnetic powder is attracted toward the other one of the electric field generating electrodes 33 and 34 and moves toward the other one of the first region 57 and the second region 58. As a result of such movement of the magnetic powder, the inductance value changes.

Figure 7:
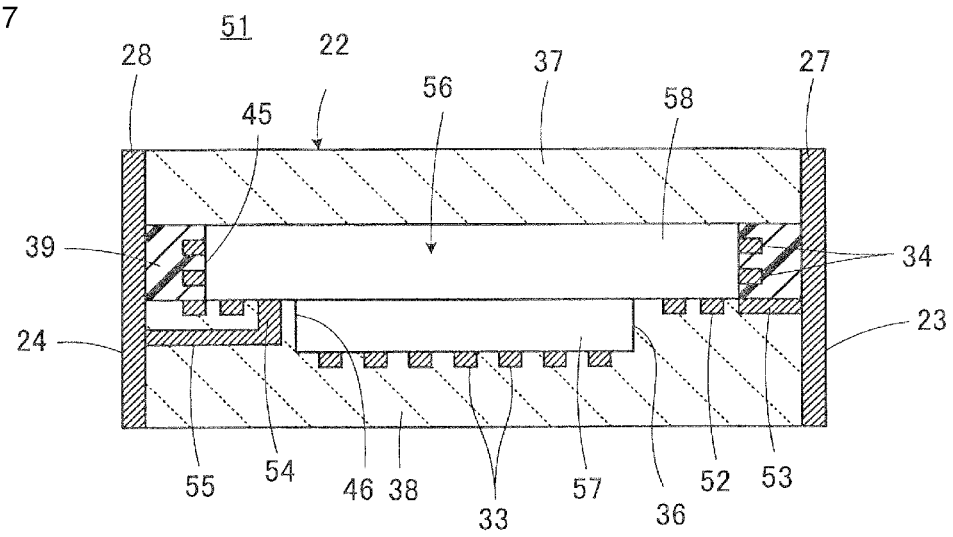
FIG. 7 is a sectional view of a variable inductor according to a fourth embodiment of the present disclosure, which corresponds to FIG. 5.

According to the variable inductor 51 illustrated in FIG. 7, since only the single coil 52 is provided, the amount of change in the inductance value is smaller than that in the above-described variable inductor 21 that includes the two coils 31 and 32.

Thus far, the present disclosure has been described in association with several illustrated embodiments, but various other modifications can also be made within the scope of the present disclosure. For example, the shape of a space defined by a receptacle portion can be modified as desired as long as a given shape traverses at least a portion of a magnetic flux produced by a coil.

In addition, the embodiments described in the present specification are illustrative in nature, and the configurations can be partially replaced or combined among different embodiments.

While the embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A variable inductor, comprising:

at least one coil that produces a magnetic flux;

a receptacle portion that defines a space traversing at least a portion of the magnetic flux produced by the at least one coil, the receptacle portion that defines the space including a first end surface and a second end surface opposed to the first end surface across a first region of the space, and the receptacle portion that defines the space including a third end surface positioned between the first end surface and the second end surface in a second region of the space that protrudes from the first region of the space; and a magnetic powder contained in the receptacle portion so as to occupy a portion of the space, wherein the at least one coil is positioned on opposite sides of the first end surface, wherein the magnetic powder is movable within the space from the first region to the second region, and movable from the second region to the first region, and this movement produces a change in the magnetic flux, wherein a straight line connecting the space between any two points of the first end surface and the second end surface is continuous, and wherein a central axis of the at least one coil passes through the space.

2. The variable inductor according to claim 1, wherein a magnetic field provided by the at least one coil is relatively strong in the first region and the magnetic field is relatively weak in the second region, and wherein the magnetic powder is movable between the first region and the second region.

3. The variable inductor according to claim 1, wherein the at least one coil includes first and second coils disposed coaxially with a gap provided therebetween, wherein the first coil and the second coil are configured to mutually cancel out magnetic fields provided thereby, and wherein at least a portion of the space is located between the first and second coils.

4. The variable inductor according to claim 1, wherein the magnetic powder is coated with a resin having an electrostatic property, wherein the variable inductor further includes an electric field generating electrode for applying a voltage so as to generate an electric field within the space, and wherein the magnetic powder is moved within the space by applying a voltage to the electric field generating electrode.

5. The variable inductor according to claim 4, wherein the electric field generating electrode includes a substantially comb-shaped portion spreading along a wall surface of the receptacle portion that defines the space.

6. The variable inductor according to claim 1, wherein the magnetic powder moves within the space by its own weight.

7. The variable inductor according to claim 1, wherein the magnetic powder is movable from the first end surface and the second end surface of the first region to the third end surface of the second region, and the magnetic powder is movable from the third end surface of the second region to the first end surface and the second end surface of the first region.

8. The variable inductor according to claim 1, including a guide surface that protrudes into the space.

9. The variable inductor according to claim 8, wherein the guide surface is conical.

10. The variable inductor according to claim 8, wherein the guide surface is position at a location that is directly between the first end surface and the second end surface.

11. A variable inductor, comprising:

at least one coil that produces a magnetic flux;

a receptacle portion that defines a space traversing at least a portion of the magnetic flux produced by the at least one coil, the receptacle portion that defines the space including a first end surface, a second end surface, and a third end surface arranged to form a T-shape; and a magnetic powder contained in the receptacle portion so as to occupy a portion of the space, wherein the at least one coil is positioned on opposite sides of one of the first end surface, the second end surface, and the third end surface located in a crossbar of the T-shape, wherein the magnetic powder is movable within the space from one of the first end surface, the second end surface, and the third end surface, to two other surfaces of the first end surface, the second end surface, and the third end surface, and this movement produces a change in the magnetic flux, wherein a straight line connecting the space between any two points of the first end surface and the second end surface is continuous, and wherein a central axis of the at least one coil passes through the space.

12. The variable inductor according to claim 11, wherein the space defined by the receptacle portion includes a first region in which a magnetic field provided by the at least one coil is relatively strong and a second region in which the magnetic field is relatively weak, and wherein the magnetic powder is movable between the first region and the second region.

13. The variable inductor according to claim 11, wherein the at least one coil includes first and second coils disposed coaxially with a gap provided therebetween, wherein the first coil and the second coil are configured to mutually cancel out magnetic fields provided thereby, and wherein at least a portion of the space is located between the first and second coils.

14. The variable inductor according to claim 11, wherein the magnetic powder moves within the space by its own weight.

15. The variable inductor according to claim 11, including a guide surface that protrudes into the space.

16. The variable inductor according to claim 15, wherein the guide surface is conical.

17. The variable inductor according to claim 15, wherein the guide surface is position at a location that is directly between the first end surface and the second end surface.

18. The variable inductor according to claim 15, wherein the space includes a plurality of end surfaces, and the protrusion is positioned at a location that is directly between two of the end surfaces.

19. A variable inductor, comprising:

at least one coil that produces a magnetic flux;

a receptacle portion that defines a space traversing at least a portion of the magnetic flux produced by the at least one coil, the receptacle portion including a pair of opposing end surfaces on separate sides of the space, and a protrusion that is separate and distinct from the space extending from the space to cross a line extending directly between opposing ends of the at least one coil that are perpendicular to at least one of the opposing end surfaces; and a magnetic powder contained in the receptacle portion so as to occupy a portion of the space, wherein the magnetic powder is movable within the space, and this movement produces a change in the magnetic flux, and a central axis of the at least one coil passes through the space.

20. The variable inductor according to claim 19, wherein the protrusion is a guide surface having a conical shape.

* * * * *